US005633114A

United States Patent [19]

Waterman

[11] Patent Number: 5,633,114

[45] **Date of Patent: *May 27, 1997**

[54] IMAGE-RECEIVING ELEMENT WITH PARTICLE CONTAINING OVERCOAT FOR DIFFUSION TRANSFER FILM PRODUCTS

[75] Inventor: Kenneth C. Waterman, Arlington, Mass.

[73] Assignee: Polaroid Corporation, Cambridge, Mass.

[ * ] Notice: The term of this patent shall not extend beyond the expiration date of Pat. No. 5,415,969.

[21] Appl. No.: 672,499

[22] Filed: Jun. 28, 1996

Related U.S. Application Data

[63] Continuation of Ser. No. 382,880, Feb. 2, 1995, abandoned, which is a continuation-in-part of Ser. No. 132,534, Oct. 6, 1993, Pat. No. 5,415,969.

[51] Int. Cl.[6] ..... G03C 8/40; G03C 8/52; G03C 8/50; G03C 1/805

[52] U.S. Cl. ..... 430/203; 430/215; 430/227; 430/259; 430/262; 430/263; 430/961

[58] Field of Search ..... 430/203, 215, 430/227, 259, 262, 263, 961

[56] References Cited

U.S. PATENT DOCUMENTS

| | | | |
|---|---|---|---|
| 3,591,379 | 7/1971 | Plakunov | 96/50 |
| 3,594,165 | 7/1971 | Rogers | 96/3 |
| 4,080,346 | 3/1978 | Bedell | 260/17 |
| 4,190,449 | 2/1980 | Naoi et al. | 430/539 |
| 4,298,682 | 11/1981 | Bishop | 430/533 |
| 4,346,160 | 8/1982 | Bishop | 430/215 |
| 4,429,032 | 1/1984 | Matthe et al. | 430/231 |
| 4,489,152 | 12/1984 | Oberhauser et al. | 430/229 |
| 4,499,174 | 2/1985 | Bishop et al. | 430/215 |
| 4,668,602 | 5/1987 | Hosaka et al. | 430/207 |
| 4,728,595 | 3/1988 | Hayashi et al. | 430/227 |
| 4,769,306 | 9/1988 | Oberhauser et al. | 430/220 |
| 5,135,835 | 8/1992 | Aono et al. | 430/215 |
| 5,273,858 | 12/1993 | Coppens et al. | 430/204 |
| 5,366,855 | 11/1994 | Anderson et al. | 430/961 |
| 5,415,969 | 5/1995 | Waterman | 430/215 |
| 5,447,832 | 9/1995 | Wang et al. | 430/961 |

FOREIGN PATENT DOCUMENTS

| | | |
|---|---|---|
| 0045695 | 2/1982 | European Pat. Off. . |
| 0154377 | 9/1985 | European Pat. Off. . |
| 0222045 | 5/1987 | European Pat. Off. . |
| 0388532 | 9/1990 | European Pat. Off. . |
| 0521423 | 1/1993 | European Pat. Off. . |

*Primary Examiner*—Richard L. Schilling
*Attorney, Agent, or Firm*—Gaetano D. Maccarone

[57] ABSTRACT

An image-receiving element for use in photographic and photothermographic diffusion transfer film units of the type wherein the image-receiving element is designed to be removed or "peeled-apart" from a photosensitive element following exposure and processing. The present image-receiving element comprises in sequence, a support, an image-receiving layer, and an overcoat layer. The overcoat layer comprises a major amount by dry weight of water-insoluble particles and a minor amount by dry weight of a water-insoluble polymeric latex binder material. The water-insoluble particles may comprise inorganic particles such as colloidal silica, and/or organic particles such as water-insoluble polymeric latex particles.

15 Claims, 1 Drawing Sheet

IMAGE-RECEIVING ELEMENT WITH PARTICLE CONTAINING OVERCOAT FOR DIFFUSION TRANSFER FILM PRODUCTS

CROSS-REFERENCE TO RELATED APPLICATION

This application is a continuation of prior U.S. patent application Ser. No. 08/382,880 filed Feb. 2, 1995, now abandoned, which application is, in turn, a continuation-in-part of application Ser. No. 08/132,534 filed Oct. 6, 1993 now U.S. Pat. No. 5,415,969.

BACKGROUND OF THE INVENTION

This invention relates to an image-receiving element for use in photographic and photothermographic film units of the diffusion transfer type. More particularly, the invention relates to an image-receiving element especially adapted for use in diffusion transfer film units of the type wherein an image-receiving element is designed to be separated from a photosensitive element after exposure and processing.

Photographic film units for use in diffusion transfer type photographic processes are well known. Such film units including both "peel apart" (i.e. wherein an image-receiving element is separated from a photosensitive element after exposure and processing) and "integral" (wherein the image-receiving element and photosensitive element are maintained as a superimposed integral unit after exposure and processing) formats. Various embodiments of "peel apart" and "integral" formats are known in the art including those wherein images are formed in black and white, and color, as described in: E. H. Land, H. G. Rogers, and V. K. Walworth, in J. M. Sturge, ed., *Neblette's Handbook of Photography and Reprography*, 7th ed., Van Nostrand Reinhold, N.Y., 1977, pp. 258–330; and V. K. Walworth and S. H. Mervis, in J. Sturge, V. Walworth, and A. Shepp, eds., *Imaging Processes and Materials: Neblette's Eighth Edition*, Van Nostrand Reinhold, N.Y., 1989, pp. 181–225. Additional examples of "peel apart" film units are described in U.S. Pat. Nos. 2,983,606; 3,345,163; 3,362,819; 3,594,164; and 3,594,165.

In general, diffusion transfer photographic products and processes involve film units having a photosensitive element including at least one silver halide layer. After photoexposure, the photosensitive element is developed, generally by uniformly distributing an aqueous alkaline processing composition over the photoexposed element, to establish an imagewise distribution of a diffusible image-providing material. The image-providing material, (typically image dyes or complexed silver), is selectively transferred, at least in part, by diffusion to an image-receiving layer or element positioned in a superposed relationship with the developed photosensitive element and capable of mordanting or otherwise fixing the image-providing material. The image-receiving layer retains the transferred image for viewing. In diffusion transfer photographic products of the "peel-apart" format, the image is viewed in the image-receiving layer upon separation of the image-receiving element from the photosensitive element after a suitable imbibition period. With "integral" formats, such separation is not required.

Black and white transfer images are generally formed by exposing and developing a silver halide emulsion, and subsequently dissolving and transferring silver from unexposed, or less exposed regions, to an image-receiving layer containing silver precipitating agents or nuclei. Color images are generally formed by the imagewise transfer of image dyes from a photosensitive element to an image-receiving layer containing a dye mordant material.

Image-receiving elements particularly adapted for use in "peel-apart" diffusion transfer film units usually include an image-receiving layer for retaining the transferred image. This image-receiving layer is typically arranged on a substrate layer of suitable material or a combination of layers arranged on the substrate layer, each of the layers providing specific and desired functions adapted to the formation of the desired image in accordance with diffusion transfer processing. In one well known photographic embodiment, the image-receiving element comprises a support material (preferably, an opaque support material carrying a light-reflecting layer for the viewing of the desired transfer image thereagainst by reflection); a polymeric acid-reacting (neutralizing) layer adapted to lower the environmental pH of the film unit subsequent to substantial transfer image formation; a spacer or timing layer adapted to slow the diffusion of the alkali of an aqueous alkaline processing composition toward the polymeric neutralizing layer; and an image-receiving layer to receive the transferred photographic image. Such a structure is described, for example, in the aforementioned U.S. Pat. No. 3,362,819 and is illustrated in other patents, including U.S. Pat. Nos. 4,322,489 and 4,547,451.

Photothermographic film products for use in diffusion transfer type processes are also well known in the art. Various embodiments of such film products are known and typically comprise: 1) a photosensitive element including at least one photosensitive silver halide emulsion and a corresponding image providing material (e.g. silver for black and white embodiments, image dyes for color embodiments), and 2) an image-receiving element including an image receiving layer. Typically, the photosensitive element is exposed and subsequently brought in superposed contact with the image-receiving element, wherein the assembly is heated for a predetermined time period. In addition to heating, some applications require a small amount of water to be added to the photosensitive element prior to lamination with the image-receiving element. The application of heat, (and water if used), results in the image-wise diffusion of image materials from the photosensitive element, to the image-receiving element. Subsequently, the image-receiving element is separated from the photosensitive element. Various embodiments of photothermographic film units and processes are described in: S. H. Mervis and V. K. Walworth, *Kirk-Othmer Encyclopedia of Chemical Technology*, 4th. Edition, Volume 6, John Wiley & Sons, Inc. 1993, pp. 1036–1039. Specific examples of such film units are described in U.S. Pat. Nos. 4,631,251; 4,650,748; 4,656,124; 4,704,345; 4,975,361; and 5,223,387.

The surface of the image-receiving elements used in "peel apart" photographic and photothermographic film products is often susceptible to tackiness due to the absorption of moisture. Moisture may be provided by the environment, or by way of the processing conditions, which may include the introduction of water and/or other processing liquid. As a result of the absorption of moisture, the surface of the image-receiving element may become wet and sticky. As such, image-receiving elements often cannot be stacked upon one another during storage and/or manufacturing without blocking, i.e. sticking between individual elements.

Furthermore, in photographic embodiments, the surface of the image-receiving element often remains wet and sticky for some period of time after it has been separated from the photosensitive element. During this time period care must be exercised in the handling of the photograph so as not to damage it. Further, in instances where it is desired to place the photograph in a holder of some type for storage purposes, or where it is desired to laminate a protective layer over the photograph, it is necessary to wait until the surface of the photograph is sufficiently dry to permit it to be handled in that manner. The time period required to allow such handling varies dependent upon various factors such as the amount of liquid taken up by the image-receiving layer during photographic processing and the ambient relative humidity and temperature conditions. Additionally at any time after processing and drying, the photograph may encounter humid conditions which can render the surface of the photograph wet and sticky.

Thus, it is desired to provide an image-receiving element which maintains a relatively non-stick, substantially dry outer surface under humid environmental conditions. Furthermore, with photographic film units, it is desired to reduce the time period following photographic processing before which the image-receiving element can be further handled.

SUMMARY OF THE INVENTION

The present invention is an image-receiving element for use in a photographic and photothermographic film units of the diffusion transfer type. The present image-receiving element comprises in sequence, a support, an image-receiving layer, and an overcoat layer. The overcoat layer comprises a major amount by dry weight of water-insoluble particles and a minor amount by dry weight of a water-insoluble polymeric latex binder material. The water-insoluble particles may comprise inorganic particles such as colloidal silica, and/or organic particles such as water-insoluble polymeric latex particles. The binder material helps prevent cracking of the overcoat layer during coating and drying and/or during processing.

The overcoat layer, in addition to allowing sufficient image-providing material to pass through to the image-receiving layer to provide a photograph of the desired quality, must not scatter visible light to any appreciable degree so as not to interfere with viewing of the photograph. This requirement can be accomplished in accordance with the invention by various techniques such as utilizing water-insoluble particles and binder material whose indices of refraction are substantially matched and/or utilizing water-insoluble particles having a particle size small enough so as not to significantly scatter light.

The subject overcoat layer provides an image-receiving element which remains substantially non-sticky under humid environmental conditions, thus improving handling and storage of pre-processed image-receiving elements and post processed photographs. Moreover, in regard to photographic applications, the subject overcoat layer significantly reduces the time period that the surface of a resulting photograph remains wet and sticky after photographic processing and separation of the image-receiving element from the photosensitive element. Furthermore, it has been found that the image-receiving element of the invention provides for the transfer of sufficient image-providing material to the image-receiving layer to provide the desired photographic quality and does not appreciably interfere with viewing of the photograph.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DETAILED DESCRIPTION OF THE PREFERRED EMBODIMENTS

The present invention is an image-receiving element for use in "peel apart" photographic and photothermographic film units of the diffusion transfer type. As will be described in detail below, the subject image-receiving element comprises in sequence, a support, an image-receiving layer, and an overcoat layer. The overcoat layer comprises a major amount by dry weight of water-insoluble particles and a minor amount by dry weight of a water-insoluble polymeric latex binder material.

Figure 1:
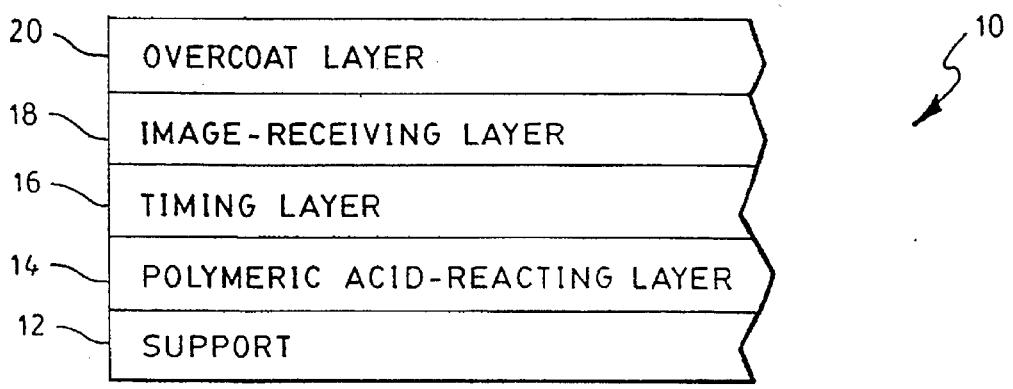
FIG. 1 is a partially schematic, cross-sectional view of one embodiment of an image-receiving element according to the invention.

With reference to FIG. 1, an image-receiving element specifically adapted for use in a photographic "peel apart" film unit is shown. More specifically, there is shown an image-receiving element 10 according to the invention comprising a support layer 12 carrying a polymeric acid-reacting layer 14, a timing (or spacer) layer 16, an image-receiving layer 18 and an overcoat layer 20. Each of the layers carried by support layer 12 functions in a predetermined manner to provide desired diffusion transfer processing and is described in detail hereinafter.

Support material 12 can comprise any of a variety of materials capable of carrying layers 14, 16, 18, and 20, as shown in FIG. 1. Paper, vinyl chloride polymers, polyamides such as nylon, polyesters such as polyethylene terephthalate, or cellulose derivatives such as cellulose acetate or cellulose acetatebutyrate, can be suitably employed. Depending upon the desired nature of the finished photograph, the nature of support material 12 as a transparent, opaque or translucent material will be a matter of choice. Typically, an image receiving element adapted to be used in "peel-apart" diffusion transfer film units and designed to be separated after processing will be based upon an opaque support material 12. While support material 12 of image-receiving element 10 will preferably be an opaque material for production of a photographic reflection print, it will be appreciated that support 12 will be a transparent support material where the processing of a photographic transparency is desired. In one embodiment where support material 12 is a transparent sheet material, an opaque sheet (not shown), preferably pressure-sensitive, can be applied over the transparent support to permit in-light development. Upon processing and removal of the opaque pressure-sensitive sheet, the photographic image diffused into image-receiving layer 20 can be viewed as a transparency. In another embodiment where support material 12 is a transparent sheet, opacification materials such as carbon black and titanium dioxide can be incorporated in the processing composition to permit in-light development.

Figure 2:
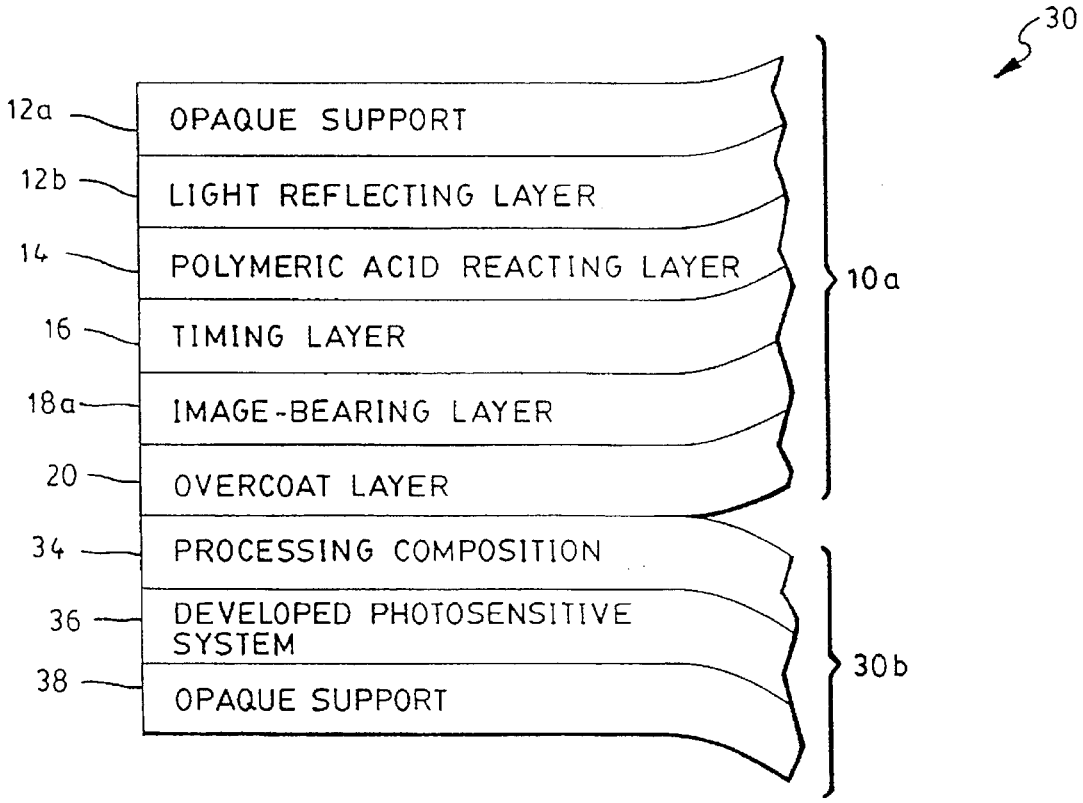
FIG. 2 is a partially schematic, cross-sectional view of a photographic film unit according to the invention, shown after exposure and processing.

With reference to FIG. 2, a color diffusion transfer "peel apart" type film unit according to the present invention is generally shown at 30. The film unit 30 includes a photo-exposed photosensitive element **30*b* comprising a processing composition layer 34, a developable photosensitive system 36 and an opaque support 38. The film unit 30 is shown after photographic processing and prior to separation of an image-receiving element 10*a* from a processed photosensitive element 30*b*. Prior to processing, the processing composition 34 is typically contained within a pod as is common in the art. The processing composition typically comprises an aqueous alkaline solution including a developing agent and other addendum as is known in the art. Examples of such processing compositions are found in the following U.S. Pat. Nos. and the patents cited therein: 4,756,996; 3,455,685; 3,597,197; 4,680,247 and (Ser. No. 08/243,974). The photosensitive system 36 comprises a photosensitive silver halide along with a corresponding diffusible dye, which upon processing is capable of diffusing to the image-receiving layer 18** as a function of exposure.

In further reference to FIG. 2, an image-receiving element 10*a* is generally shown, including layers 12, 14, 16, 18 and 20 as described with reference to FIG. 1 wherein like numerals are used. More specifically, an image-receiving element 10*a* is shown including a support 12*a*. The support may comprise an opaque support material 12*a*, such as paper, carrying a light-reflecting layer 12*b* thereon. On separation of the image-bearing photograph 10*a*, the image in image-bearing layer 18*a* can be viewed against light-reflecting layer 12*b*. Light-reflecting layer 12*b* can comprise, for example, a polymeric matrix containing a suitable white pigment material, e.g., titanium dioxide.

The image-receiving elements of the present invention are especially adapted to utilization in film units intended to provide multicolor dye images. The most commonly employed negative components for forming multicolor images are of the "tripack" structure and contain blue-, green-, and red-sensitive silver halide layers, each having associated therewith in the same or in a contiguous layer a yellow, a magenta and a cyan image dye-providing material, respectively. Suitable photosensitive elements and their use in the processing of diffusion transfer photographs are well known and are disclosed, for example, in U.S. Pat. No. 3,345,163 (issued Oct. 3, 1967 to E. H. Land, et al.); in U.S. Pat. No. 2,983,606 (issued May 9, 1961 to H. G. Rogers); and in U.S. Pat. No. 4,322,489 (issued Mar. 30, 1982 to E. H. Land, et al.). Photosensitive elements which include dye developers and a dye-providing thiazolidine compound can be used with good results and are described in U.S. Pat. No. 4,740,448 to P. O. Kliem.

In the embodiments illustrated in FIGS. 1 and 2, the image-receiving element 10, 10*a* includes a polymeric acid-reacting layer 14. The polymeric acid-reacting layer 14 reduces the environmental pH of the film unit, subsequent to transfer image formation. As disclosed, for example, in the previously referenced U.S. Pat. No. 3,362,819, the polymeric acid-reacting layer may comprise a nondiffusible acid-reacting reagent adapted to lower the pH from the first (high) pH of the processing composition in which the image material (e.g. image dyes) is diffusible to a second (lower) pH at which they are not diffusible. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or tactones. Thus, reduction in the environmental pH of the film unit is achieved by the conduct of a neutralization reaction between the alkali provided by the processing composition and layer 14 which comprises immobilized acid-reactive sites and which functions as a neutralization layer. Preferred polymers for neutralization layer 14 comprise such polymeric acids as cellulose acetate hydrogen phthalate; polyvinyl hydrogen phthalate; polyacrylic acid; polystyrene sulfonic acid; and maleic anhydride copolymers and half esters thereof.

Polymeric acid-reacting layer 14 can be applied, if desired, by coating support layer 12 with an organic solvent-based or water-based coating composition. A polymeric acid-reacting layer which is typically coated from an organic-based composition comprises a mixture of a half butyl ester of polyethylene/maleic anhydride copolymer with polyvinyl butyral. A suitable water-based composition for the provision of polymeric acid-reacting layer 14 comprises a mixture of a water soluble polymeric acid and a water soluble matrix, or binder, material. Suitable water-soluble polymeric acids include ethylene/maleic anhydride copolymers and poly(methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid-reacting layers, in addition to those disclosed in the aforementioned U.S. Pat. Nos. 3,362,819 and 3,756,815, mention may be made of those disclosed in the following U.S. Pat. Nos.: 3,765,885; 3,819,371; 3,833,367 and 3,754,910. A preferred polymeric acid-reacting layer 14 comprises a free acid of a copolymer of methyl vinyl ether and maleic anhydride and a vinyl acetate ethylene latex.

Timing layer 16 controls the initiation and the rate of capture of alkali by the acid-reacting polymer layer 14. The timing layer 16 may be designed to operate in a number of ways. For example, the timing layer 16 may act as a sieve, slowly metering the flow of alkali there through. Alternatively, the timing layer 16 may serve a "hold and release" function; that is, the timing layer 16 may serve as an alkali impermeable barrier for a predetermined time interval before converting in a rapid and quantitatively substantial fashion to a relatively alkali permeable condition, upon the occurrence of a predetermined chemical reaction. Timing layer 16 can be provided by resort to polymeric materials which are known in the diffusion transfer art and which are described, for example, in U.S. Pat. Nos. 4,201,587; 4,288,523; 4,297,431; 4,391,895; 4,426,481; 4,458,001; 4,461,824 and 4,547,451. As described in these patents, timing layers having the previously described characteristics can be prepared from polymers which comprise repeating units derived from polymerizable monomeric compounds containing groups which undergo a predetermined chemical reaction as a function of contact with alkali and which are then rendered permeable to alkali. Monomeric compounds which are capable of undergoing a beta-elimination or which undergo an hydrolytic degradation after a predetermined period of impermeability to alkali can be employed in the production of suitable polymeric timing layer materials.

Polymeric materials suitable for the production of timing layer 16 will typically be copolymers comprising repeating units of the previously described type (i.e., repeating units derived from polymerizable monomers capable of undergoing an alkali-initiated chemical reaction after a predetermined "hold" time interval) and comonomeric units incorporated into the polymer to impart thereto predetermined properties. For example, the "hold time", i.e., the time interval during which timing layer 16 remains impermeable to alkali during processing, can be affected by the relative hydrophilicity of the layer resulting from incorporation of a given comonomer or mixture of comonomers into the timing layer polymer. In general, the more hydrophobic the polymer, the slower will be the rate of permeation of alkali into the timing layer to initiate the alkali-activated chemical reaction, i.e., the longer the alkali hold time. Alternatively, adjustment of the hydrophobic/hydrophilic balance of the polymer by inclusion of appropriate comonomeric units may be used to impart predetermined permeability characteristics to a timing layer as appropriate for a given usage within a film unit.

The predetermined hold time of timing layer 16 can be adjusted as appropriate for a given photographic process by means such as controlling the molar ratio or proportion of repeating units which undergo the desired alkali-initiated chemical reaction; altering the thickness of the timing layer; incorporation of appropriate comonomeric units into the polymeric to impart thereto a desired hydrophobic/hydrophilic balance or degree of coalescence; using different activating groups to affect the initiation and rate of the alkali-initiated chemical reaction; or utilizing other materials, particularly polymeric materials, in the timing layer to modulate the permeation of alkali into timing layer 16, thereby altering the time necessary for initiation of the desired and predetermined chemical reaction. This latter means of adjusting the hold time of timing layer 16 may include, for example, utilization of a matrix polymer material having a predetermined permeability to alkali or aqueous alkaline processing composition as determined, for example, by the hydrophobic/hydrophilic balance or degree of coalescence thereof.

In general, increased permeability to alkali or aqueous alkaline processing composition, and thus, a shorter hold time, may be obtained by increasing the hydrophilicity of the matrix polymer or decreasing the degree of coalescence. Alternatively, decreased permeability of alkali or aqueous alkaline processing composition into timing layer 16 and, thus, a longer hold time, may be obtained by increasing the hydrophobicity of the matrix polymer or increasing the degree of coalescence.

Examples of suitable comonomers which can be used in the production of copolymeric materials suited to application in timing layer 16 include acrylic acid; methacrylic acid; 2-acrylamido-2-methylpropane sulfonic acid; N-methyl acrylamide; methacrylamide; ethyl acrylate; butyl acrylate; methyl methacrylate; N-methyl methacrylamide; N-ethyl acrylamide; N-methylolacrylamide; N,N-dimethyl acrylamide; N,N-dimethyl methacrylamide; N-(n-propyl) acrylamide; N-isopropyl acrylamide; N-(b-hydroxy ethyl) acrylamide, N-(b-dimethylaminoethyl)acrylamide; N-(t-butyl)acrylamide; N-[b-(dimethylamino)ethyl] methacrylamide; 2-[2'-(acrylamido)ethoxy]ethanol; N-(3'-methoxy propyl)acrylamide; 2-acrylamido-3-methol butyramide; acrylamido acetamide; methacrylamido acetamide; 2-[2-methacrylamido-3'-methyl butyramido] acetamide; and diacetone acrylamide.

Matrix polymer systems adapted to utilization in timing layer 16 can be prepared by physical mixing of the matrix polymer and the polymer containing the repeating units capable of undergoing alkali-initiated chemical reaction, or by the preparation of the timing layer polymer in the presence of a pre-formed matrix polymer. Polymers which may be used as matrix polymers will generally be copolymers which comprise comonomer units such as acrylic acid; methacrylic acid; methyl methacrylate; 2-acrylamido-2-methylpropane sulfonic acid; acrylamide; methacrylamide; N,N-dimethyl acrylamide; ethyl acrylate; butyl acrylate; diacetone acrylamide; acrylamido acetamide; methacrylamido acetamide.

In the production of copolymeric timing layer materials, and in the production of matrix polymers, the comonomeric units, as well as the ratios thereof, should be chosen on the basis of the physical characteristics desired in the matrix polymer and in the timing layer in which it is to be utilized.

Reference has been made to the utilization (in timing layers containing polymers capable of undergoing alkali-initiated chemical reaction) of other materials, particularly polymeric materials, to adjust the hold time of the timing layer in a predetermined manner and as appropriate for a given photographic process. It will be understood, however, that the presence in timing layer 16 of polymer or other materials which adversely affect or negate the desired alkali impermeable barrier properties of timing layer 16 is to be avoided. In this connection, it should be noted that gelatin, and particularly unhardened gelatin, is readily swollen and permeated by aqueous alkaline compositions typically employed in photographic processing. Accordingly, the presence in a timing layer of the invention of amounts of gelatin or other materials which promote rapid permeation of the layer by alkali and which effectively negate the hold character of the layer are to be avoided. Timing layer 16 is typically applied as a water-impermeable layer which results from the coalescence and drying of a coating composition, e.g., a latex composition.

In color embodiments of the present invention, the image-receiving layer 18, 18*a* generally comprises a dyeable material which is permeable to the alkaline processing composition. The dyeable material may comprise polyvinyl alcohol together with a polyvinyl pyridine polymer such as poly(4-vinyl pyridine). Such image-receiving layers are further described in U.S. Pat. No. 3,148,061 to Howard C. Haas. A preferred image-receiving layer material comprises a graft copolymer of 4-vinyl pyridine and vinylbenzyltrimethylammonium chloride grafted onto hydroxyethyl cellulose. Such graft copolymers and their use as image-receiving layers are further described in U.S. Pat. Nos. 3,756,814 and 4,080,346 issued to Stanley F. Bedell. Other materials can, however, be employed. Suitable mordant materials of the vinylbenzyltrialkylammonium type are described, for example, in U.S. Pat. No. 3,770,439, issued to Lloyd D. Taylor. Mordant polymers of the hydrazinium type (such as polymeric mordants prepared by quaternization of polyvinylbenzyl chloride with a disubstituted asymmetric hydrazine) can be employed. Such mordants are described in Great Britain Pat. No. 1,022,207, published Mar. 9, 1966. A preferred hydrazinium mordant is poly(1-vinylbenzyl 1,1-dimethylhydrazinium chloride) which, for example, can be admixed with polyvinyl alcohol for provision of a suitable image-receiving layer.

Overcoat layer 20 typically has a thickness of up to about 2 microns, and preferably between 1 and 1.5 microns. Moreover, the overcoat layer 20 must allow sufficient image-providing material to be transferred to image-receiving layer 18 to provide a photograph of the desired quality. Furthermore, in the embodiment provided in FIG. 2, the overcoat layer 20 should not scatter visible light to any appreciable degree since the photograph is viewed through overcoat layer 20. The subject overcoat layer 20 significantly reduces the amount of time during which the surface of the photograph remains wet and sticky.

As described previously, the overcoat layer 20 comprises water-insoluble particles in a binder material. Preferably, the overcoat layer 20 comprises a majority by dry weight of water-insoluble particles and a minority by dry weight of the binder material. More preferably, the overcoat layer 20 comprises between about 60–90% by dry weight of the water-insoluble particles and about 10–40% by dry weight of the binder material, though the exact percentages are dependent upon the specific materials used. The particles are substantially insoluble in water and non-swellable when wet. Furthermore, in order to minimize any light scatter by overcoat layer 20, the particles typically have a small average particle size, for example, less than 300 nm and preferably less than 100 nm, and more preferably in the range of about 1 nm to 50 nm. The water-insoluble particles may comprise inorganic materials, e.g. colloidal silica, and or organic materials, e.g. water-insoluble polymeric latex particles such as an acrylic emulsion resin.

Colloidal silica is the preferred inorganic particle for use in the subject overcoat layer 20, however, other inorganic particles may be used in combination or substituted therefor, e.g. titania, barium sulfate, alumina, alumina silicates, etc. When using colloidal silica particles, it has been found that blends of colloidal silica particles having different average particles sizes can help prevent cracking in the overcoat layer 20. The overcoat layer 20 can be coated from a coating fluid made up of colloidal silica sol.

Although the overcoat layer 20 preferably includes inorganic particles, e.g. colloidal silica, overcoat layer 20 need not include such inorganic particles. That is, the overcoat layer 20 may include organic polymeric particles as the sole source of particles. An example of such an overcoat layer comprises water-insoluble polymeric latex particles, e.g. JONCYRL® 95 and a water-insoluble latex polymer binder material, e.g. HYCAR® 26349.

Preferred water-insoluble polymeric latex particles have a minimum film forming temperature in the range of about 10° C. to 40° C. and a glass transition temperature of at least 10° C. greater than their minimum film forming temperature. Such materials should be coatable without significant coalescence, i.e. capable of forming films without significant coalescence among individual particles. Thus, when coated, the particles maintain independent configurations with interstitial spaces therebetween. An example of such a material is JONCRYL® 95 available from SC Johnson Wax, Racine, Wis.

The binder material for overcoat layer 20 comprises a water-insoluble latex material which should be permeable to the photographic aqueous alkaline processing fluid and also to the image-providing material (which transfers to the image-receiving layer 18 to provide the photograph). The term "latex" as used herein is intended to describe a stable aqueous dispersion of a polymer. The binder material typically has a low molecular weight, for example, from about 10,000 to about 100,000 such that the viscosity of the material is low and does not act as a significant impediment to transfer of the image-providing material. The binder material is chosen to help prevent cracking in layer 20 during coating and drying of the layer and/or during photographic processing. Examples of such water-insoluble polymer latex binder materials include HYCAR® 26349, a self-crosslinking alkali swellable acrylate latex material available from the B. F. Goodrich Company, Specialty Polymers and Chemicals Division, Cleveland Ohio. In general, such materials should be elastic enough to prevent cracking of the overcoat layer 20. Materials having a glass transition temperature below 0° C. tend to be sticky at room temperature and as such, are less desirable.

Blends of binder materials having different glass transition temperatures (Tg) can be used in overcoat layer 20. Materials having a relatively high Tg, i.e., above about 50° C., can be used to help prevent crack propagation. Typical suitable materials which have a relatively high Tg include HOSTAFLON TF™ 5032 (a polytetrafluoroethylene latex dispersion available from Hoechst Corp.) and NEOCRYL™ A-639 (a latex dispersion of an acrylate copolymer available from Zeneca Resins, Inc., Wilmington, Mass.). Materials which have a relatively low Tg, i.e., from about 0° C. to about 50° C. and preferably from about 0° C. to about 25° C., can be used to absorb stress because of their ability to spread and fill areas during dimensional changes which occur during drying of the element (after coating) and photographic processing, thereby reducing or eliminating cracking. Typical suitable materials which have a relatively low Tg include JONCRYL® 77 (a water dispersible styrene-acrylic polymer available from S. C. Johnson & Son, Racine, Wis.), NEOCRYL™ BT24 and NEOCRYL™ BT520 (alkali soluble latex dispersions of acrylate copolymers available from Zeneca Resins, Inc.). In a preferred embodiment, a blend of high Tg and low Tg materials is used as the binder for overcoat layer 20.

As noted previously, the overcoat layer 20 should not scatter visible light to any appreciable degree so as not to interfere with viewing of the photograph. As previously stated, one way of reducing light scatter is through the use of particles having a small average particle size as described above. Light scatter can be further minimized by using binder materials which have an index of refraction substantially the same as that of the particles. Furthermore, reducing the total amount of particles and/or binder coated will further minimize light scatter.

Preferably, the overcoat layer 20 is substantially water-insoluble (i.e. excludes any significant amount of water-soluble materials including binder materials which are water-soluble). Thus, the overcoat layer 20 is not sticky when wet with water or processing composition. However, water-soluble binder materials may be used in combination with water-insoluble binder materials. Examples of applicable water soluble binder materials include ethylene acrylic acid, polyvinyl alcohol, gelatin, and the like.

The binder materials described hereinabove may be soluble in the solvent from which layer 20 is coated, e.g. water, organic solvents, etc. Furthermore, the binder material may be insoluble in the solvent from which layer 20 is coated, e.g. a water-insoluble latex binder material coated with water as the solvent.

Overcoat layer 20 may also include other addendum including surfactant materials which enhance the fluid stability of the coating fluid, function as a coating aid and/or provide surface lubrication to layer 20 after separation of the image-receiving and photosensitive elements, thus rendering the layer less sticky.

A particularly preferred overcoat layer 20 according to the invention comprises a 7.2:1:1.6 (parts by weight) ratio of: colloidal silica particles having an average particle size of about 14 nm; and as a binder material, polytetrafluoroethylene particles having an average particle size of about 150 nm±100 nm and an acrylate copolymer latex dispersion having a Tg of about 25° C.

Another preferred overcoat layer 20 in accordance with the present invention comprises a 1:1:1 ratio (parts by weight) of: colloidal silica particles having an average particle size of about 12 nm (available as an aqueous colloidal dispersion of silica particles including sodium as a stabilizing counter ion, from Dupont Corporation under the name LUDOX® AM), water-insoluble acrylic latex particles having a minimum film forming temperature of about 20° C. and a glass transition temperature of about 43° (available from Johnson Wax, Specialty Chemicals under the name JONCRYL® 95), and as a binder material, a water-insoluble latex polymer (available from the B. F. Goodrich Company, Specialty Polymers & Chemicals Division under the name HYCAR® 26349).

The opaque support 38 can comprise a number of materials as described with respect to support 12.

With continued reference to the preferred photographic embodiment of the subject invention, the image-receiving element 10 preferably includes a strip-coat layer (not shown) coated over overcoat layer 20. The strip-coat layer can be used as a means of facilitating separation of image-receiving element 10*a* from a photosensitive element 30*b*. For example, in photographic film unit 30 which is processed by distribution of an aqueous alkaline processing composition 34 between the image-receiving element 10*a* and a photo-exposed photosensitive element 30*b*, the strip-coat layer would function to facilitate separation of the photograph 10*a* from the developed photosensitive system 36, processing composition layer 34 and support 38 (collectively 30*b*).

Such a strip-coat layer can be prepared from a variety of hydrophilic colloid materials. Preferred hydrophilic colloids for a strip-coat layer include gum arabic, carboxymethyl cellulose, hydroxyethyl cellulose, carboxymethyl hydroxyethyl cellulose, cellulose acetatehydrogen phthalate, polyvinyl alcohol, polyvinyl pyrrolidone, methyl cellulose, ethyl cellulose, cellulose nitrate, sodium alginate, pectin, polymethacrylic acid, polymerized salts or alkyl, aryl and alkyl sulfonic acids (e.g., DAXAD™, W. R. Grace Co.), polyoxyethylene polyoxypropylene block copolymers (e.g., PLURONIC™ F-127, BASF Wyandotte Corp.) or the like.

The strip-coat layer can comprise a solution of hydrophilic colloid and ammonia as described in U.S. Pat. No. 4,009,031 and can be coated from an aqueous coating solution prepared by diluting concentrated ammonium hydroxide (about 28.7% $NH_4OH$) with water to the desired concentration, preferably from about 2% to about 8% by weight, and then adding to this solution an aqueous hydrophilic colloid solution having a total solids concentration in the range of about 1% to about 5% by weight. The coating solution also may include a small amount of a surfactant, for example, less than about 0.10% by weight of TRITON™ X-100, available from Rohm and Haas, Co., Phila., Pa. A preferred solution comprises about 3 parts by weight of ammonium hydroxide and about 2 parts by weight of gum arabic.

A particularly preferred strip-coat layer comprises a mixture of a hydrophilic colloid such as gum arabic and an aluminum salt such as aluminum lactate. An image-receiving element which includes a strip-coat layer comprising a hydrophilic colloid and an aluminum salt is disclosed and claimed in commonly-assigned U.S. Pat. No. 5,346,800 issued Sep. 13, 1994 to James A. Foley, Nicholas S. Hadzekyriakides and James J. Reardon.

Although the image-receiving layer of the invention has been described in detail with respect to the preferred embodiment illustrated in FIGS. 1 and 2, it should be noted that the subject overcoat layer may be used in conjunction with any image-receiving element used in diffusion transfer photographic film units. For example, the diffusion transfer photographic film unit described in Japanese patent application 561-252685, filed Oct. 23, 1986, is formed by placing a photosensitive element on a white supporting structure which is made up of at least: a) a layer having a neutralizing function; b) a pigment-receiving layer; and c) a peelable layer. The photosensitive element includes at least one silver halide emulsion layer associated with an image dye-providing material, an alkaline developing substance containing a light-shielding agent and a transparent cover sheet. An overcoat layer according to the present invention can be arranged between the image-receiving layer and the peelable layer of this type of diffusion transfer film unit to reduce the period of time that the image-receiving element remains wet, or tacky, after separation.

The image-receiving element of the present invention is also applicable to "black and white" photographic film units. In such embodiments, a photosensitive element including a photosensitive silver halide emulsion is exposed to light and subject to an aqueous alkaline solution comprising a silver halide developing agent and a silver halide solvent. The developing agent reduces exposed silver halide to metallic silver and the solvent reacts with un-reduced silver halide to form a soluble silver salt complex. This soluble silver salt complex migrates to an image-receiving element. The image-receiving element typically comprises a support and an image-receiving layer including a silver precipitating material wherein the soluble silver salt complex is precipitated or reduced to form a visible silver "black and white" image. The binder material for the overcoat layer in black and white embodiments should be permeable to the photographic alkaline processing fluid and to complexed silver salt which transfers to the image-receiving layer to provide an image. Examples of such black and white photographic film units are disclosed in U.S. Pat. Nos. 3,567,442; 3,390,991; and 3,607,269 and in E. H. Land, H. G. Rogers, and V. K. Walworth, in J. M. Sturge, ed., *Neblette's Handbook of Photography and Reprography*, 7th ed., Van Nostrand Reinhold, N.Y., 1977, pp. 258–330.

As previously stated, the subject image-receiving element is also intended for use within photothermographic film units. Various embodiments of such film products are known and typically comprise: 1) a photosensitive element including at least one photosensitve silver halide emulsion, and with color embodiments, a corresponding image dye providing material, and 2) an image-receiving element including an image receiving material. Typically, the photosensitive element is exposed and subsequently brought in superposed contact with the image-receiving element, wherein the assembly is heated for a predetermined time period. In addition to heating, some applications require a small amount of water to be added to the photosensitive element prior to lamination with the image-receiving element. The application of heat, (and water if used), results in the image-wise diffusion of image materials (e.g. complexed silver in black and white embodiments, image dyes in color embodiments) from the photosensitive element, to the image-receiving element. Subsequently, the image-receiving element is separated from the photosensitive element. Various embodiments of photothermographic film units and processes are described in: S. H. Mervis and V. K. Walworth, *Kirk-Othmer Encyclopedia of Chemical Technology*, 4th. Edition, Volume 6, John Wiley & Sons, Inc. 1993, pp. 1036–1039. Specific examples of such film units are described in U.S. Pat. Nos.: 4,631,251; 4,650,748; 4,656,124; 4,704,345; 4,975,361; and 5,223,387. Typically, image-receiving elements used in photothermographic film units would not include the timing and/or acid-reacting layers as described with reference to the preferred photographic embodiment.

The invention will now be described further in detail with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE I

An image-receiving element was prepared comprising the following layers coated in succession on a white-pigmented polyethylene coated opaque support:

1. a polymeric acid-reacting layer, at a coverage of about 2390 mgs/ft$^2$ (about 25726 mgs/m$^2$), comprising 9 parts GANTREZ™ S-97 (from GAF Corp.), a free acid of a copolymer of methyl vinyl ether and maleic anhydride and 11 parts AIRFLEX™ 465 (Air Products Co.) vinyl acetate ethylene latex;
2. a timing layer coated at a coverage of about 250 mgs/ft$^2$ (about 2691 mgs/m$^2$) comprising a copolymer of diacetone acrylamide and acrylamide grafted onto polyvinyl alcohol;
3. a hold-release timing layer coated at a coverage of about 235 mgs/ft$^2$ (about 2529 mgs/m$^2$) comprising a copolymer of diacetone acrylamide/butyl acrylate/carboxymethoxymethyl acrylate/methacrylic acid;
4. an image-receiving layer coated at a coverage of about 300 mgs/ft$^2$ (about 3229 mgs/m$^2$) of a graft copolymer comprising 4-vinyl pyridine (4VP) and vinyl benzyl trimethylammonium chloride (TMQ) grafted onto hydroxyethylcellulose (HEC);
5. a strip coat layer coated at a coverage of about 86 mgs/ft$^2$ (about 926 mgs/m$^2$) of gum arabic.

This image-receiving element was used as a means of establishing a comparative evaluation with image-receiving elements according to the invention and is identified herein as CONTROL.

EXAMPLE II

Image-receiving elements (A–E) according to the invention were prepared in the same manner as the CONTROL with the exception that each included an overcoat layer between the image-receiving layer and the strip-coat layer as follows:

Image-receiving element A—an overcoat layer comprising a 7.2:1:1.6 mixture of: colloidal silica having a particle size of about 14 nm (NYACOL™ 1430 LS); polytetrafluoroethylene latex dispersion (HOSTAFLON TF™ 5032) and an acrylate copolymer latex dispersion (NEOCRYL™ BT520) having a Tg of about 25° C.

Image-receiving element B—included an overcoat layer comprising a 7.2:1:1.6 mixture of colloidal silica having an average particle size of about 14 nm; polytetrafluoroethylene latex dispersion and an acrylate copolymer latex dispersion (NEOCRYL™ BT24) having a Tg of about 7° C.;

Image-receiving element C—included an overcoat layer comprising a 7.2:1:1.6 mixture of colloidal silica having an average particle size of 14 nm; polytetrafluoroethylene latex dispersion and a styrene-acrylic acid copolymer latex dispersion (JONCRYL™ 77 from S. C. Johnson & Son).

Image-receiving element D—included an overcoat layer comprising a 7.2:1:1.6 mixture of colloidal silica having an average particle size of 14 nm, polytetrafluoroethylene latex dispersion and ethylene acrylic acid;

Image-receiving element E—included an overcoat layer comprising a 60/40 mixture of colloidal silica particles (a 9:1 ratio of average particle size of 14:100 nm) and an acrylate copolymer latex dispersion (NEOCRYL™ BT24).

EXAMPLE III

The previously described image-receiving elements of Examples I and II (the CONTROL and A–E) were evaluated in "peel-apart" photographic film units in the following manner:

A photosensitive element was utilized for the processing and evaluation of each of the image-receiving elements. The photosensitive element comprised an opaque subcoated polyethylene terephthalate photographic film base having the following layers coated thereon in succession:

1. a layer of sodium cellulose sulfate coated at a coverage of about 25 mgs/m$^2$;
2. a cyan dye developer layer comprising about 960 mgs/m$^2$ of the cyan dye developer represented by the formula

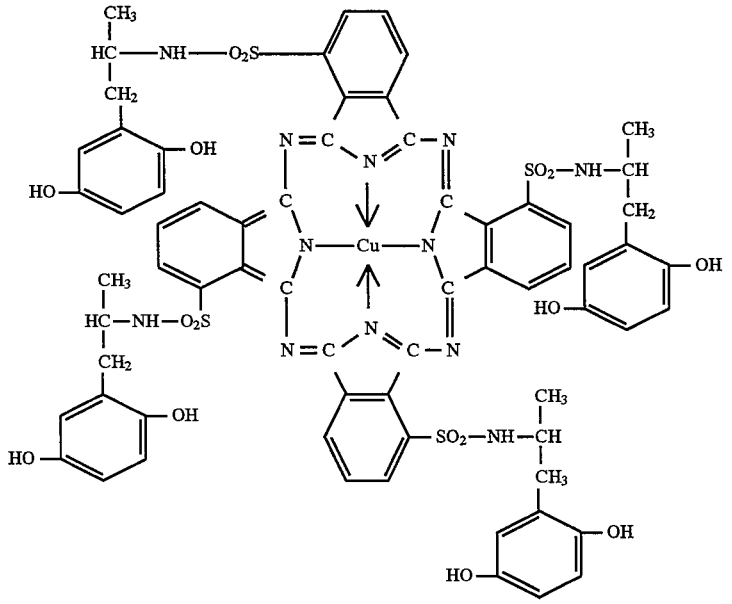

about 540 mgs/m$^2$ of gelatin and about 245 mgs/m$^2$ of phenyl norbornenyl hydroquinone (PNEHQ);

3. a red-sensitive silver iodobromide layer comprising about 780 mgs/m$^2$ of silver (0.6 micron), about 420 mgs/m$^2$ of silver (1.5 microns) and about 60 mgs/m$^2$ of gelatin;
4. an interlayer comprising about 2325 mgs/m$^2$ of a copolymer of butyl acrylate/diacetone acrylamide/methacrylic acid/styrene/acrylic acid, about 97 mgs/m$^2$ of polyacrylamide, about 124 mgs/m$^2$ of dantoin and about 3 mgs/m$^2$ of succindialdehyde;
5. a magenta dye developer layer comprising about 455 mgs/m$^2$ of a magenta dye developer represented by the formula

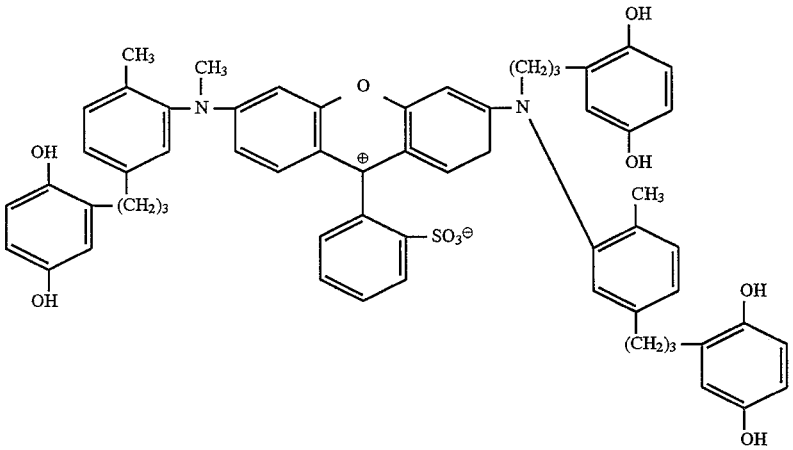

about 240 mgs/m$^2$ of gelatin and about 234 mgs/m$^2$ of 2-phenyl benzimidazole;
6. a spacer layer comprising about 250 mgs/m$^2$ of carboxylated styrenebutadiene latex (Dow 620 latex) and about 83 mgs/m$^2$ of gelatin;
7. a green-sensitive silver iodobromide layer comprising about 540 mgs/m$^2$ of silver (0.6 micron), about 360 mgs/m$^2$ of silver (1.3 microns) and about 396 mgs/m$^2$ of gelatin;
8. a layer comprising about 263 mgs/m$^2$ of PNEHQ and about 116 mgs/m$^2$ of gelatin;
9. an interlayer comprising about 1448 mgs/m$^2$ of the copolymer described in layer 4 and about 76 mgs/m$^2$ of polyacrylamide and about 4 mgs/m$^2$ of succindialdehyde;
10. a layer comprising about 1000 mgs/m$^2$ of a scavenger, 1-octadecyl-4,4-dimethyl-2-[2-hydroxy-5-(N-(7-caprolactamido)sulfonamido]thiazolidine and about 416 mgs/m$^2$ of gelatin;
11. a yellow filter layer comprising about 241 mgs/m$^2$ of benzidine yellow dye and about 120 mgs/m$^2$ of gelatin;
12. a yellow image dye-providing layer comprising about 1257 mgs/m$^2$ of a yellow image dye-providing material represented by the formula

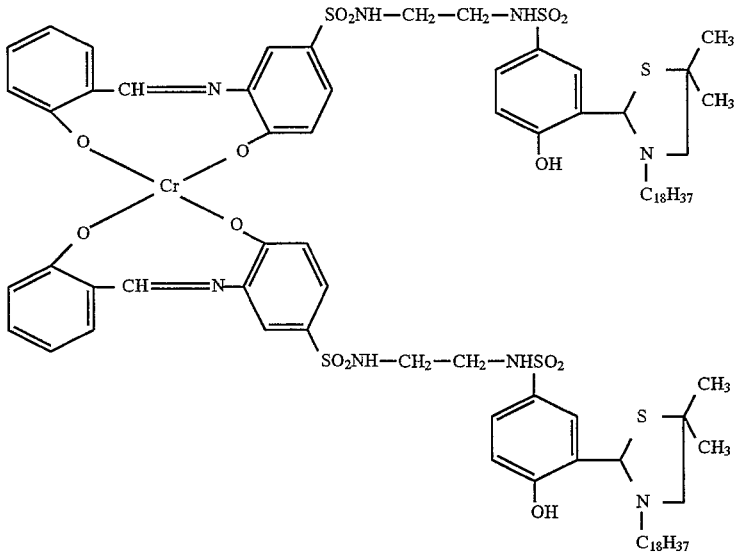

and about 503 mgs/m$^2$ of gelatin;

13. a blue-sensitive silver iodobromide layer comprising about 37 mgs/m$^2$ of silver (1.3 microns), about 208 mgs/m$^2$ of silver (1.6 microns), and about 108 mgs/m$^2$ of gelatin;
14. about 450 mgs/m$^2$ of phenyl tertiarybutyl hydroquinone, about 150 mgs/m$^2$ of 5-t-butyl-2,3-bis[(1-phenyl-1H-tetrazol-5-yl)thio]-1,4-benzenediol bis[(2-methanesulfonylethyl)carbamate]; and about 250 mgs/m$^2$ of gelatin;
15. a layer comprising about 500 mgs/m$^2$ of an ultraviolet filter, Tinuvin (Ciba-Geigy), about 190 mgs/m$^2$ of benzidine yellow dye and about 345 mgs/m$^2$ of gelatin; and
16. a layer comprising about 300 mgs/m$^2$ of gelatin.

Film units were prepared utilizing each of the receiving elements of Examples I and II (i.e. the CONTROL and A–E) and the above-described photosensitive element. In each case, after photoexposure of the photosensitive element, the image-receiving element and the photosensitive element were arranged in face-to-face relationship, i.e. (with their respective supports outermost) and a rupturable container containing an aqueous alkaline processing composition was affixed between the image-receiving and photosensitive elements at the leading edge of each film unit such that the application of compressive pressure to the container would rupture the seal of the container along its marginal edge and distribute the contents uniformly between the respective elements. The composition of the aqueous alkaline processing composition utilized for the processing of each film unit is set forth in Table I.

TABLE I

| Processing Composition | |
|---|---|
| Component | Parts by Weight |
| Potassium hydroxide | 5.1 |
| 1-(4-hydroxyphenyl)-1H-tetrazole-5-thiol | 0.004 |
| N-butyl-a-picolinium bromide | 1.8 |
| 1-methylimidazole | 0.25 |
| 1,2,4-triazole | 0.606 |
| hypoxanthine | 1.03 |
| 3,5-dimethylpyrrazole | 0.418 |
| sodium hydroxide | 1.28 |
| 2-(methylamino)ethanol | 0.25 |
| Guanine | 0.125 |
| Aluminum hydroxide hydrate | 0.24 |
| 5-amino-1-pentanol | 0.5 |
| Hydroxyethylcellulose | 2.86 |
| Chlorobenzenesulfinate | 1.0 |
| Titanium dioxide | 0.17 |
| 6-methyl uracil | 0.46 |
| Water | Balance to 100 |

Each film unit was subjected to exposure to a standard photographic sensitometric target and was processed at room temperature (about 20° C.) by spreading the processing composition between the image-receiving and photosensitive elements as they were brought into superposed relationship between a pair of pressure rollers having a gap of about 0.0036". After an imbibition period of about 90 seconds, the image-receiving element in each case was separated from the remainder of the film unit to reveal the image.

The Dmin area of the photograph obtained from each image-receiving element was evaluated with a tissue test to determine the time period necessary to allow the surface to be handled. In this test a tissue paper was placed in pressure contact with the surface of the photograph for about 3–5 seconds and then pulled away. This test was pre-formed after differing time intervals following the separation of the image-receiving element from the photosensitive element. The tissue tackiness time reported is the number of minutes (following separation of the elements) before no fiber is transferred from the tissue to the surface of the photograph, thus indicating when the photograph could be further handled such as by placing it in an envelope for storage.

In addition, Dmin photographs obtained with the CONTROL and image-receiving elements A–E were placed in envelopes, with pressure, for a period of at least one hour after differing time intervals following separation of the respective elements. The envelope tackiness time reported is the number of minutes (following separation of the elements) before no fiber is transferred from the envelope to the surface of the photograph. The results of this testing are shown in Table III.

EXAMPLE IV

A photographic film unit was prepared and tested in a substantially similar manner as that described above with respect to EXAMPLES I–III. More specifically, an image-receiving element F was prepared comprising the following layers coated in succession on a white-pigmented polyethylene coated opaque support:

1. a polymeric acid-reacting layer, at a coverage of about 2390 mgs/ft$^2$ (about 25726 mgs/m$^2$), comprising 9 parts GANTREZ™ S-97 (from GAF Corp.), a free acid of a copolymer of methyl vinyl ether and maleic anhydride and 11 parts AIRFLEX™ 465 (Air Products Co.), a vinyl acetate ethylene latex;
2. a timing layer coated at a coverage of about 250 mgs/ft$^2$ (about 2691 mgs/m$^2$) comprising a copolymer of diacetone acrylamide and acrylamide grafted onto polyvinyl alcohol;
3. a hold-release timing layer coated at a coverage of about 235 mgs/ft$^2$ (about 2529 mgs/m$^2$) comprising a copolymer of diacetone acrylamide/butyl acrylate/carboxymethoxymethyl acrylate/methacrylic acid;
4. an image-receiving layer coated at a coverage of about 300 mgs/ft$^2$ (about 3229 mgs/m$^2$) of a graft copolymer comprising 4-vinyl pyridine (4VP) and vinyl benzyl trimethylammonium chloride (TMQ) grafted onto hydroxyethylcellulose (HEC);
5. an overcoat layer coated at a coverage of about 50 mg/ft$^2$ comprising 1 part colloidal silica (LUDOX® AM), 1 part water-insoluble latex polymer binder material (HYCAR® 26349), and 1 part water-insoluble acrylic latex particles (JONCRYL® 95).
6. a strip coat layer coated at a coverage of about 140 mgs/ft$^2$ comprising 4 parts aluminum lactate and 3 parts gum arabic.

Image-receiving element F was evaluated in a photographic film unit in a substantially similar manner as described previously with respect to image-receiving elements A–E. The photosensitive element utilized for the processing and evaluation of image-receiving element F comprised an opaque subcoated polyethylene terephthalate photographic film base having the following layers coated thereon in succession:

1. a layer of sodium cellulose sulfate coated at a coverage of about 19 mgs/m$^2$;

2. a cyan dye developer layer comprising about 960 mgs/m$^2$ of the cyan dye developer represented by the formula

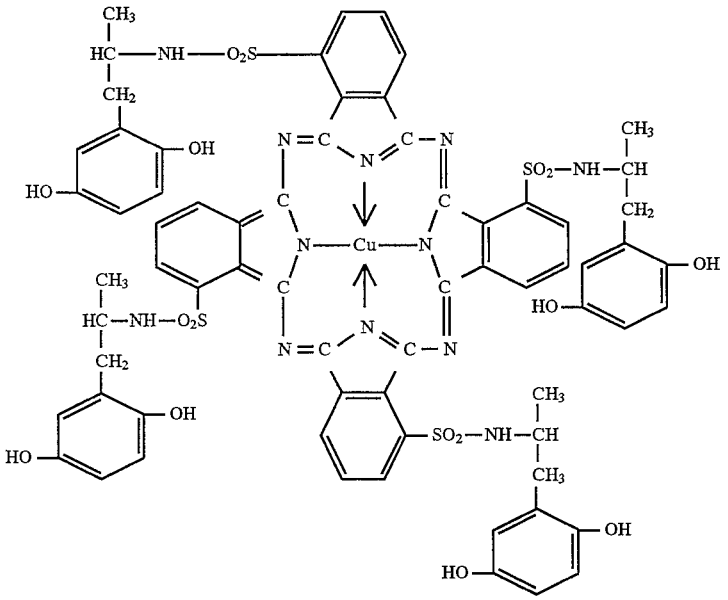

about 540 mgs/m$^2$ of gelatin, about 12 mgs/m$^2$ of sodium cellulose sulfate and about 245 mgs/m$^2$ of phenyl norbornenyl hydroquinone (PNEHQ);

3. a red-sensitive silver iodobromide layer comprising about 780 mgs/m$^2$ of silver (0.6 micron), about 420 mgs/m$^2$ of silver (1.5 microns), about 720 mgs/m$^2$ of gelatin and about 18 mgs/m$^2$ of polyvinyl hydrogen phthalate;
4. an interlayer comprising about 2325 mgs/m$^2$ of a copolymer of butyl acrylate/diacetone acrylamide/methacrylic acid/styrene/acrylic acid, about 97 mgs/m$^2$ of polyacrylamide, about 124 mgs/m$^2$ of dantoin and about 3 mgs/m$^2$ of succindialdehyde;
5. a magenta dye developer layer comprising about 455 mgs/m$^2$ of a magenta dye developer represented by the formula

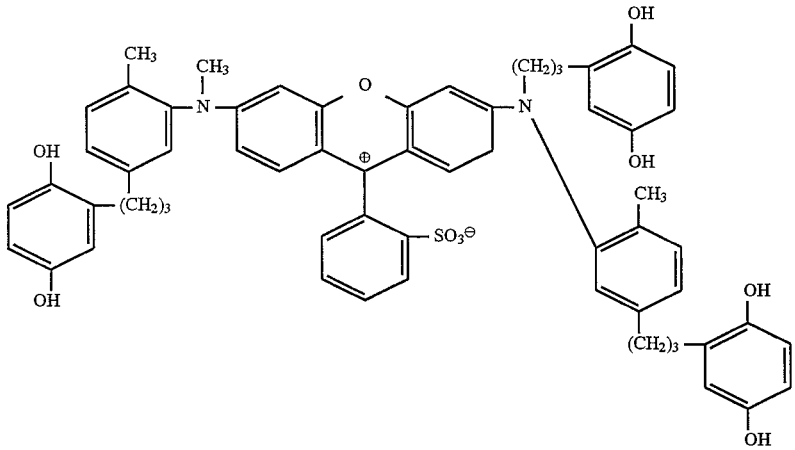

about 298 mgs/m$^2$ of gelatin, about 234 mgs/m$^2$ of 2-phenyl benzimidazole, about 14 mgs/m$^2$ of phthalocyanine blue filter dye and about 12 mgs/m$^2$ of sodium cellulose sulfate;

6. a spacer layer comprising about 250 mgs/m$^2$ of carboxylated styrenebutadiene latex (Dow 620 latex), about 83 mgs/m$^2$ of gelatin and about 2 mgs/m$^2$ of polyvinyl hydrogen phthalate;
7. a green-sensitive silver iodobromide layer comprising about 540 mgs/m$^2$ of silver (0.6 micron), about 360 mgs/m$^2$ of silver (1.3 microns), about 418 mgs/m$^2$ of gelatin and about 23 mgs/m$^2$ of polyvinyl hydrogen phthalate;
8. a layer comprising about 263 mgs/m$^2$ of PNEHQ, about 131 mgs/m$^2$ of gelatin and about 4 mgs/m$^2$ of sodium cellulose sulfate;
9. an interlayer comprising about 1448 mgs/m$^2$ of the copolymer described in layer 4 and about 76 mgs/m$^2$ of polyacrylamide and about 4 mgs/m$^2$ of succindialdehyde;

10. a layer comprising about 1000 mgs/m$^2$ of a scavenger, 1-octadecyl-4,4-dimethyl-2-[2-hydroxy-5-(N-(7-caprolactamido)sulfonamido]thiazolidine, about 405 mgs/m$^2$ of gelatin, about 12 mgs/m$^2$ of sodium cellulose sulfate and about 7 mgs/m$^2$ of quinacridone red zeta;

11. a yellow filter layer comprising about 241 mgs/m$^2$ of benzidine yellow dye, about 68 mgs/m$^2$ of gelatin and about 3 mgs/m$^2$ of sodium cellulose sulfate;

12. a yellow image dye-providing layer comprising about 1257 mgs/m$^2$ of a yellow image dye-providing material represented by the formula

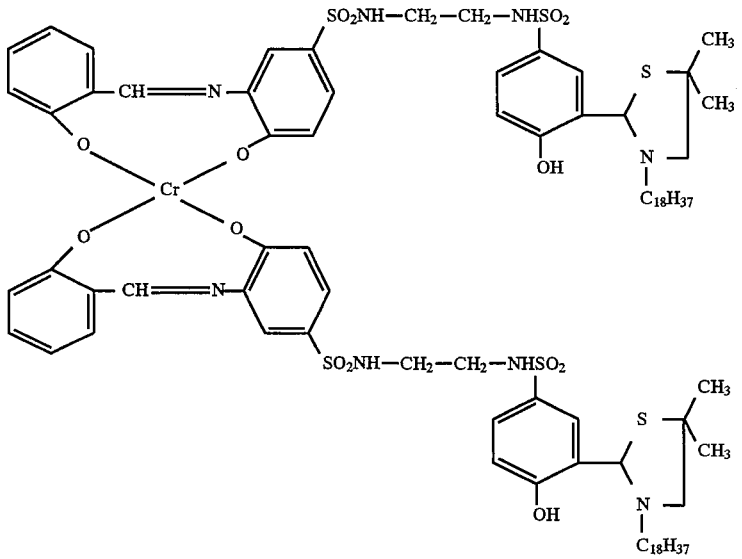

about 503 mgs/m$^2$ of gelatin and about 20 mgs/m$^2$ of sodium cellulose sulfate;

13. about 450 mgs/m$^2$ of phenyl tertiarybutyl hydroquinone, about 100 mgs/m$^2$ of 5-t-butyl-2,3-bis[(1-phenyl-1H-tetrazol-5-yl)thio]-1,4-benzenediol bis[(2-methanesulfonylethyl)carbamate]; about 250 mgs/m$^2$ of gelatin and about 33 mgs/m$^2$ of polyvinylhydrogen phthalate;

14. a blue-sensitive silver iodobromide layer comprising about 37 mgs/m$^2$ of silver (1.3 microns), about 208 mgs/m$^2$ of silver (1.6 microns), about 78 mgs/m$^2$ of gelatin and about 7 mgs/m$^2$ of polyvinyl-hydrogen phthalate;

15. a layer comprising about 500 mgs/m$^2$ of an ultraviolet filter, Tinuvin (Ciba-Geigy), about 220 mgs/m$^2$ of benzidine yellow dye, about 310 mgs/m$^2$ of gelatin and about 23 mgs/m$^2$ of sodium cellulose sulfate; and 16. a layer comprising about 300 mgs/m$^2$ of gelatin and about 9 mgs/m$^2$ of polyvinylhydrogen phthalate.

The composition of the aqueous alkaline processing composition utilized for the processing of the film unit of EXAMPLE IV is set forth in Table II.

TABLE II

| Processing Composition | |
|---|---|
| Component | Parts by Weight |
| Potassium hydroxide | 6.6 |
| 1-(4-hydroxyphenyl)-1H-tetrazole-5-thiol | 0.005 |
| N-butyl-a-picolinium bromide | 2.1 |
| 1-methylimidazole | 0.30 |
| 1,2,4-triazole | 0.499 |

TABLE II-continued

| Processing Composition | |
|---|---|
| Component | Parts by Weight |
| hypoxanthine | 1.30 |
| 3,5-dimethylpyrrazole | 0.180 |
| sodium hydroxide | 1.52 |
| 2-(methylamino)ethanol | 0.30 |
| Guanine | 0.150 |
| Alumminum hydroxide hydrate | 0.29 |
| 5-amino-1-pentanol | 0.66 |
| Hydroxyethylcellulose | 3.41 |
| Chlorobenzenesulfinate | 1.1 |
| Titanium dioxide | 0.20 |
| 6-methyl uracil | 0.55 |
| bis(6-benzylaminopurine) | 0.015 |
| Water | Balance to 100 |

The photographic film unit of EXAMPLE IV was subjected to same testing conditions as previously described with respect to EXAMPLES I–III. The results of the testing are shown in Table III.

It can be seen that the image-receiving elements according to the invention exhibit a significantly reduced time period after which they can be further handled. It can also be seen, from the red, green and blue Dmax values, that the image-receiving elements according to the invention also allowed sufficient image-dye providing materials to diffuse to the image-receiving layer to provide an acceptable photograph.

TABLE III

| Photograph from Image-Receiving Element | Tissue Tackiness Time (min) | Envelope Tackiness Time (min) | Dmax R | Dmax G | Dmax B |
|---|---|---|---|---|---|
| CONTROL | 15 | 6 | 2.00 | 2.21 | 1.77 |
| A | 6 | 0.5 | 1.73 | 1.97 | 1.64 |
| B | 6 | 0.5 | 1.75 | 1.97 | 1.65 |
| C | 6 | 0.5 | 1.67 | 1.97 | 1.64 |
| D | 6 | 0.5 | 1.67 | 1.97 | 1.64 |
| E | 5 | 0.5 | 1.92 | 2.04 | 1.64 |
| F | 6 | 0.5 | 1.78 | 2.06 | 1.56 |

In addition, photographs obtained with a CONTROL image-receiving element and elements A and B according to the invention were subjected to a re-humidification test wherein initially the photographs were initially allowed to dry at ambient conditions overnight. Each photograph was then placed in an envelope with sufficient pressure to keep the photograph in contact with the paper and maintained in this condition for 24 hours at 90% relative humidity. After this time period, each photograph was removed from the envelope and inspected visually for the presence of fibers adhering to the surface of the photograph.

The CONTROL photograph had a significant amount of paper fibers adhering to its surface, whereas photographs A and B, respectively, did not have any, thus indicating that the surface of the photographs according to the invention did not become wet and sticky upon rehydration.

Although the invention has been described in detail with respect to various preferred embodiments thereof, those skilled in the art will recognize that the invention is not limited thereto but rather that variations and modifications can be made which are within the spirit of the invention and the scope of the appended claims.

I claim:

1. An image-receiving element for use in a photographic or photothermographic diffusion transfer film unit wherein an image-receiving element is adapted to be separated from a photosensitive element after photoexposure and photographic processing, said image-receiving element comprising, in sequence:

a support;

an image receiving layer;

an overcoat layer residing on said image-receiving layer, said overcoat layer comprising a major amount by dry weight of water-insoluble particles and a minor amount by dry weight of a water-insoluble polymeric latex binder material, wherein said water-insoluble particles are selected from the group consisting of inorganic particles, organic polymeric latex particles having a minimum film-forming temperature of from about 10° C. to about 40° C. and a glass transition temperature of at least 10° C. greater than their minimum film-forming temperature and mixtures thereof; and an optional strip-coat layer comprising a hydrophilic colloid residing on said overcoat layer, wherein said overcoat layer is the outermost layer of said image-receiving element when said strip-coat layer is not present or said strip-coat layer, when present, is the outermost layer of said image-receiving element.

2. An image-receiving element as set forth in claim 1 wherein said overcoat layer is substantially water-insoluble.

3. An image-receiving element as set forth in claim 1 wherein said water-insoluble particles comprise an acrylic emulsion polymer.

4. An image-receiving element as set forth in claim 1 wherein said water-insoluble particles have an average particle size of less than about 50 nanometers.

5. An image-receiving element as set forth in claim 1 wherein said binder material comprises a blend of polymers having a glass transition temperature above about 50° C. and polymers having a glass transition temperature of from about 0° C. to about 25° C.

6. An image-receiving element as set forth in claim 5 wherein said polymer of said binder material having a glass transition temperature above about 50° C. is polytetrafluoroethylene.

7. An image-receiving element as set forth in claim 1 wherein said overcoat layer comprises between about 60–90% by dry weight of said water-insoluble particles and between about 10–40% by dry weight of said water-insoluble polymeric latex binder material.

8. A photographic diffusion transfer film unit wherein an image-receiving element is adapted to be separated from a photosensitive element after photoexposure and photographic processing, said film unit comprising:

a photosensitive element comprising a support carrying at least one silver halide emulsion;

an image-receiving element arranged in superposable relationship with said photosensitive element and comprising an overcoat layer residing on said image-receiving layer, said overcoat layer comprising a major amount by dry weight of water-insoluble particles and a minor amount by dry weight of a water-insoluble polymeric latex binder material, wherein said water-insoluble particles are selected from the group consisting of inorganic particles, organic polymeric latex particles having a minimum film-forming temperature of from about 10° C. to about 40° C. and a glass transition temperature of at least 10° C. greater than their minimum film-forming temperature and mixtures thereof and an optional strip-coat layer comprising a hydrophilic colloid residing on said overcoat layer, wherein said overcoat layer is the outermost layer of said image-receiving element when said strip-coat layer is not present or said strip-coat layer when present is the outermost layer of said image-receiving element; and means for providing an aqueous alkaline processing composition for initiating development of said silver halide emulsion after photoexposure to form an image on said image-receiving layer.

9. A photographic film unit as set forth in claim 8 wherein said overcoat layer is substantially water-insoluble.

10. A photographic film unit as set forth in claim 8 wherein said water-insoluble particles comprise an acrylic emulsion polymer.

11. A photographic film unit as set forth in claim 10 wherein said water-insoluble particles have an average particle size of less than about 50 nanometers.

12. A photographic film unit as set forth in claim 8 wherein said binder material comprises a blend of polymers having a glass transition temperature above about 50° C. and polymers having a glass transition temperature of from about 0° C. to about 25° C.

13. A photographic film unit as set forth in claim 8 wherein said polymer of said binder material has a glass transition temperature of from about 0° C. to about 25° C.

14. A photographic film unit as set forth in claim 8 wherein said overcoat layer comprises between about 60–90% by dry weight of said water-insoluble particles and between about 10–40% by dry weight of said water-insoluble polymeric latex binder material.

15. A photothermographic diffusion transfer film unit wherein an image-receiving element is adapted to be separated from a photosensitive element after photoexposure and photographic processing, said film unit comprising:

a photosensitive element comprising a support carrying at least one silver halide emulsion;

an image-receiving element arranged in superposable relationship with said photosensitive element and comprising an overcoat layer residing on said image-receiving element, said overcoat layer comprising a major amount by dry weight of water-insoluble particles and a minor amount by dry weight of water-insoluble polymeric latex binder material, wherein said water-insoluble particles are selected from the group consisting of inorganic particles, organic polymeric latex particles having a minimum film-forming temperature of from about 10° C. to about 40° C. and a glass transition temperature of at least 10° C. greater than their minimum film-forming temperature and mixtures thereof and an optional strip-coat layer comprising a hydrophilic colloid residing on said overcoat layer, wherein said overcoat layer is the outermost layer of said image-receiving element when said strip-coat layer is not present or said strip-coat layer, when present, is the outermost layer of said image-receiving element.

* * * * *